United States Patent [19]

Tesch

[11] 4,010,604

[45] Mar. 8, 1977

[54] JOINTED LINK BAND

[76] Inventor: Bernhard Tesch, Im Baumgarten 4, Ennetbuergen, Switzerland

[22] Filed: Mar. 17, 1976

[21] Appl. No.: 667,829

[30] Foreign Application Priority Data

Mar. 18, 1975 Germany ..... 2511722

[52] U.S. Cl. ..... 59/82; 59/85; 59/90

[51] Int. Cl.² ..... F16G 15/04

[58] Field of Search ..... 59/78, 80, 82, 84, 85, 59/90; 63/4

[56] References Cited

UNITED STATES PATENTS

| | | | |
|---|---|---|---|
| 386,313 | 6/1888 | Lenau | 63/4 |
| 1,598,250 | 8/1926 | Person | 59/80 |
| 2,480,015 | 8/1949 | Goode | 59/80 |
| 3,845,618 | 11/1974 | Meyerson | 59/90 |

FOREIGN PATENTS OR APPLICATIONS

| | | | |
|---|---|---|---|
| 803,684 | 4/1951 | Germany | 63/4 |
| 564,352 | 6/1957 | Italy | 59/80 |

*Primary Examiner*—C.W. Lanham
*Assistant Examiner*—Gene P. Crosby
*Attorney, Agent, or Firm*—Diller, Brown, Ramik & Wight

[57] ABSTRACT

This disclosure relates to a jointed link band comprising a plurality of links, each link including a pair of arms, a first of said arms having a pair of projections projecting transversely to the longitudinal axis of said band. A second of said arms having recesses therein receiving said projections. A retaining member is provided for preventing the disassembly of adjoining links by motion of any two links transverse to the longitudinal axis of the band.

6 Claims, 7 Drawing Figures

JOINTED LINK BAND

This invention relates to jointed-link bands such as are used in bracelets, wrist bands and the like, namely bands made of jointedly interconnected individual links each provided at one end with attachment means in the form of axle-like extensions extending transversely to the lengthwise direction of the band and at the other end with recesses for receiving the axle-like extensions, individual links engaging each other in end to end relation by way of the interengaged extension and recesses.

Jointed-link bands of this kind must meet multifold requirements. Above all, they must be quickly machine produced and offer the possibility of being shortened or lengthened easily by removing or adding such links. Beyond that, there should be in particular, the feasibility of making the links of precious metals, so that if necessary the individual link may be of thin-wall design without thereby creating problems when shaping.

In a known design of a link-bracelet, a jointed axle is provided at one end of the individual link and supported by a fastening ledge; the jointed axle may be moved into a bore in the adjoining end of the neighboring link and extending transversely to the length of the bracelet, the fastening ledge for the axle moving into a slot extending from the bore to the end of the link. Such design suffers from numerous drawbacks. Mechanical strength requires solid individual links so that there be sufficient material for the bore of the jointed axle. Nevertheless, the strength achieved is little if the slot for the fastening ledge of the jointed axle is made wide enough to provide adequate mobility between the links. On the other hand, if the slot is narrow, only little mobility will be possible. Further, the position of the jointed axle in the bore must be secured by a visible lock located on the side of the band, for instance, a pin, a set-screw or the like, whereby the appearance of the band is adversely affected.

These drawbacks and difficulties are to be wholly remedied by this invention and a design of the jointed-link band is to be achieved, which not only will meet the requirements mentioned above, but further will provide high mobility of the links with respect to each other with the links for the most part covering the system connecting and securing them. This problem is solved by the invention for a jointed-link of the kind mentioned above, in that the extensions mounted on the links are designed as pins which may move into recesses serving as pin-bearings, securing elements being provided which, upon such insertion, will index or latch or otherwise hold the pins and recesses against mutual axial displacement while, if necessary, permitting removal and/or displacement.

Regarding the design of such a jointed band, many embodiments are feasible, especially regarding the designs and arrangements of the securing elements. In what may be the simplest case, a screw might be used as the securing element, which screw threads into the wall of the link adjacent the recess and which when screwed in touches with its head in a manner to prevent removal of the pin.

A preferred design for machine production is provided with a securing element in the form of a rod or leaf-like spring rigidly connected to one of the links to be joined and which may be moved out of its normal position in order to place the pins into the pin housings or recesses and which upon insertion of the pins into the appropriate pin housings will return approximately or exactly into its initial position, resting against an extension of the other link.

In another embodiment of the invention, the securing elements provided are rod or leaf-like springs which may be placed into the housings of the links and which for the purpose of joining the links may be at least partly elastically moved out and which will return to their normal position when the links are completely jointed together, retaining the pins in place, behind which they are located.

With the above and other objects in view that will hereinafter appear, the nature of the invention will be more clearly understood by reference to the following detailed description, the appended claimed subject matter, and the several views illustrated in the accompanying drawings.

Figure 1:
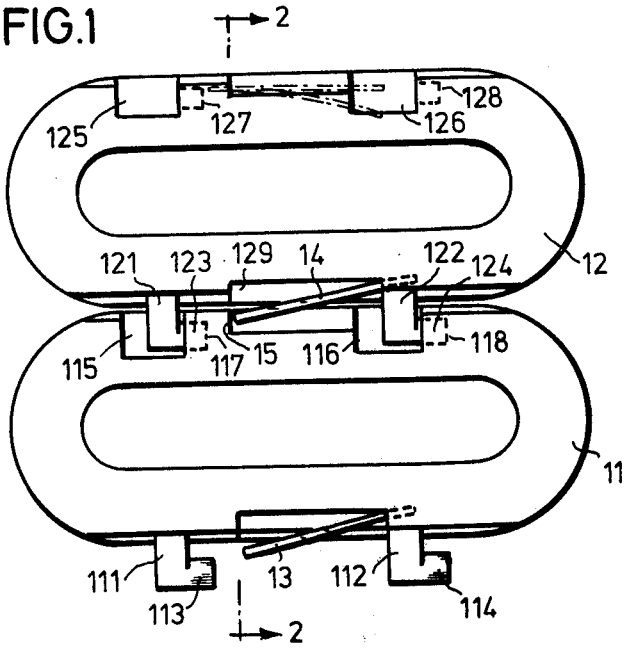
FIG. 1 is a bottom plan view of two interconnected links of a preferred embodiment of the invention.
Figure 2:
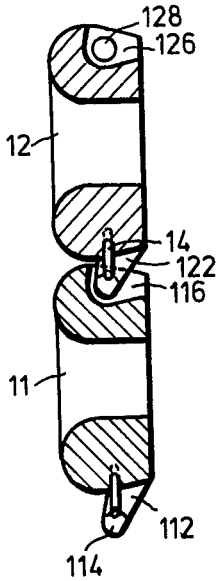
FIG. 2 is a transverse sectional view taken generally along line 2—2 of FIG. 1.

The jointed-link band of FIGS. 1 and 2 include links of elongated, oval shape which may be of most varied cross-sectional forms. The adjacent links 11, 12 of the jointed-link band are provided at respective ones of their ends with two attachments 111, 112 and 121, 122, respectively, which in turn are provided with pin-like extensions 113, 114 and 123, 124, respectively. Recesses 115, 116 are 125, 126, respectively, and adjacent pin bearings or recesses 117, 118 and 127, 128, respectively are located at the other ends of links 11, 12. When the links 11, 12 are joined together, pins 123, 124 of link 12 are pushed into pin-bearings 117, 118 of link 11 with the attachments 115, 116 being received in the recesses 115, 116.

So that the attachments 121, 122 may be guided into recesses 115, 116, a rod or leaf-like spring 14 mounted on link 12 must be moved sideways out of the way. A corresponding spring 13 is mounted on link 11. Spring 14 upon complete insertion of pins 123, 124 into bearings 117, 118 elastically returns to its unstressed position with its free end place behind a shoulder 15 formed by a recess in link 11. The spring 14 thus acts as a lock against link disengagement, but link disengagement may be easily achieved because spring 14 may be pushed back at its free end into a recess 129 of link 12 and thus may be moved past shoulder 15 in order to allow pins 123, 124 to move out of the pin-bearings 117, 118.

As shown by the dash-dot lines in FIG. 1, the spring 14 located at that end of the link where the attachments 121, 122 are mounted may be replaced by or complemented with a spring on that end of the link where the recesses 125, 126 are located and act as a securing element. Such spring upon insertion of the attachments into the recesses will be pressed back into the dash-dot line position, from which it will elastically return to its initial position when the pins of the next adjacent link have been fully inserted, and in its initial position it will be located with its free end directly behind the associated attachments of that next adjacent link.

Figure 3:
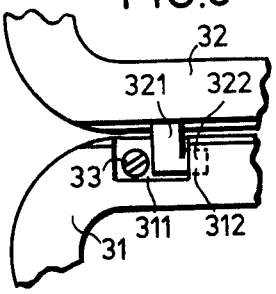
FIG. 3 is a fragmentary bottom plan view corresponding to FIG. 1 of a modified embodiment.

In FIG. 3 there is illustrated a modified embodiment in which two links to be connected are denoted by the numerals 31 and 32. By means of its attachments 321 and pins 322 thereof, link 32 engages in recesses 311 and pin-bearings 312 disposed adjacent thereto. After the links have been joined, a screw 33 is screwed into the side wall of at least one recess 311, the head of which screw will be located immediately behind attachment 321, so that the attachment 321 no longer can significantly move along the axial direction of pin 322.

Figure 4:
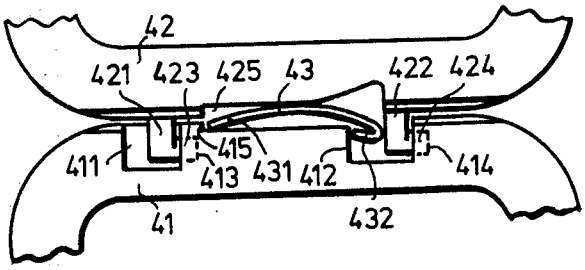
FIGS. 4 and 5 are fragmentary bottom plan views of further modifications.

In a further modified embodiment shown in FIG. 4, a spring 43 inserted in recesses at the edges of links 41 and 42 is used as the securing element. This spring preferably will be a leaf-spring. Links 41 and 42 are jointedly connected in the manner of the previously described embodiments by means of pins 423, 424 mounted on attachments 421, 422 and penetrating pin-bearings 413, 414 of recesses 411, 412. Insertion of the pins requires pressing spring 43, located between the two links, into a recess 425 of link 42. Once pins 423, 424 have been moved into pin-bearings 413, 414, spring 43 will at least in part decompress, so that it will move with its end 431 behind a shoulder 415. By means of its other end 432, which is bent back by approximately 180°, spring 43 simultaneously engages behind an edge of recess 412, the tip of end 432 resting against attachment 422.

Figure 5:
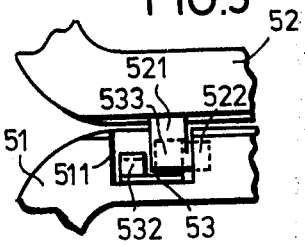
Figure 6:
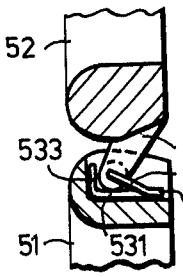
FIG. 6 is a sectional view through the embodiment of FIG. 5.
Figure 7:
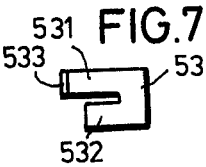
FIG. 7 is a plan view of a retaining spring.

Again a loose spring as shown in top view in FIG. 7 is used as the securing element in FIGS. 5 and 6. This spring 53 is placed in recess 511 of link 51 prior to connecting links 51 and 52 and prior to attachment 521 of link 52 being placed with pin 522 into the associated pin-bearing of link 51. Spring 53 is provided with two tongues 531 and 532, tongue 531 being provided with a tapered extension 533. Spring 53 rests against the rear wall of recess 511, while resting with both tongues on the bottom of the recess 511. Tongue 532 is bent away from the bottom of the recess at least along part of its length. This tongue 532 must be pressed back against the spring force when inserting attachment 521 with pin 522 so the latter may be inserted into the pin-bearing. When this has been done, tongue 532 elastically returns upwardly and then places itself as a lock behind attachment 521.

While preferred forms and arrangements of parts have been shown in illustrating the invention, it is to be clearly understood that various changes in details and arrangement of parts may be made without departing from the scope and spirit of this disclosure.

I claim:

1. A jointed link band comprising a plurality of interconnected links, each link having a pair of spaced arms, a first arm of each link having a pair of extensions projecting transversely to the longitudinal axis of said hand, a second arm of each link having recess means for receiving said extensions thereby interconnecting said links to each other to form said band, and means for precluding disassembly of said extensions and recess means by relative motion therebetween in a direction transverse to said longitudinal axis.

2. The jointed link band as defined in claim 1 wherein said disassembly precluding means is housed within said recess means at a side of one of said extensions outboard thereof.

3. The jointed link band as defined in claim 1 wherein said disassembly precluding means is a strip carried by said first arm of each link and is received in a recess of said second arm of each link.

4. The jointed link band as defined in claim 1 wherein said disassembly precluding means is a member disposed between each pair of extensions biasing said extensions into said recess means.

5. The jointed link band as defined in claim 1 wherein said disassembly precluding means is a spring, said spring is connected to said first arm of each link, and said second arm of each link includes a recess into which is received an end portion of said spring.

6. The jointed link band as defined in claim 1 wherein said second arm of each link includes a recess between said recess means, spring means disposed in said recess and said spring means is in bearing engagement with at least one of said extensions urging the same into said recess means.

* * * * *